US005704181A

United States Patent [19]

Fisher et al.

[11] Patent Number: 5,704,181

[45] Date of Patent: Jan. 6, 1998

[54] DISSYMETRIC BEAM CONSTRUCTION

[76] Inventors: Daniel G. Fisher, 215 Munn La., Cherry Hill, N.J. 08034; John A. Costanza, 407 Kings Hwy. West, Haddonfield, N.J. 08033; Peter A. Naccarato, 7000 Tulip St., Philadelphia, Pa. 19135

[21] Appl. No.: 421,560

[22] Filed: Apr. 13, 1995

[51] Int. Cl.[6] ..... E04B 5/23

[52] U.S. Cl. ..... 52/438; 52/338; 52/435; 52/442; 52/745.13

[58] Field of Search ..... 52/236.6, 236.7, 52/236.8, 236.9, 250, 258, 259, 283, 322, 338, 340, 434, 435, 437, 438, 442, 745.06, 745.13, 745.19, 745.2

[56] References Cited

U.S. PATENT DOCUMENTS

| | | | |
|---|---|---|---|
| 1,957,026 | 5/1934 | Lasker | 52/283 X |
| 1,990,001 | 2/1935 | Rutten | 52/250 |
| 2,006,070 | 6/1935 | Stasio | 52/259 |
| 2,021,434 | 11/1935 | Shaw | 52/435 |
| 2,233,054 | 2/1941 | Heeren | 52/338 X |
| 2,851,875 | 9/1958 | Astorga | 52/236.6 X |
| 3,130,470 | 4/1964 | Bowden et al. | 52/250 X |
| 3,495,371 | 2/1970 | Mitchell, Jr. | 52/236.7 X |
| 3,594,971 | 7/1971 | Hughes | 52/236.7 X |
| 3,732,650 | 5/1973 | Gwilliam et al. | 52/236.9 X |
| 5,113,631 | 5/1992 | diGirolamo et al. | 52/236.8 |

FOREIGN PATENT DOCUMENTS

| | | | |
|---|---|---|---|
| 429978 | 12/1948 | Italy | 52/322 |
| 570665 | 7/1945 | United Kingdom | 52/322 |
| WO88/02803 | 4/1988 | WIPO | 52/236.8 |

*Primary Examiner*—Carl D. Friedman
*Assistant Examiner*—Kevin D. Wilkens
*Attorney, Agent, or Firm*—Armand M. Vozzo, Jr.

[57] ABSTRACT

An improved structural framing system and associated method for constructing same wherein a specially configured dissymetric steel beam is horizontally disposed and supported between adjacent vertical columns erected on conventional foundations. The dissymetric beam is fabricated having a compressed, block-like top flange formed opposite a substantially flattened bottom flange and integrally connected thereto by an intermediate web. Standard hollow core sections of precast, prestressed concrete plank spanning perpendicular to the dissymetric beam are disposed on either side of the beam and together assembled thereto so that the web of the beam is disposed centrally between facing edges of the plank sections with the bottom flange of the beam supporting the lower surface of the plank and the top flange substantially aligned with the upper plank surface. Grouting of the assembled beam and plank sections with a high-strength grout mixture provides total encasement of the dissymetric beam and produces a composite action between the beam and plank that significantly increases load capacity of the system.

11 Claims, 2 Drawing Sheets

DISSYMETRIC BEAM CONSTRUCTION

BACKGROUND OF THE INVENTION

The present invention relates to the construction of multi-story buildings, and more particularly to an improved structural framing system and associated method for construction of such buildings using a composite concrete and steel assembly incorporating a specially configured dissymetric steel beam disposed between and joined along adjacent edges of precasted plank members whereby a significant horizontal shear is developed by the assembly and the composite strength of the structure is substantially enhanced.

In the field of building construction, particularly in those buildings of multiple stories, the framing system constitutes the essential loadbearing structure that characterizes and determines the strength and structural integrity of the building. Generally consisting of a plurality of vertical steel columns and horizontal steel beams spanning between and connected to each column, the basic framing system further includes a floor slab typically composed of reinforced concrete and steel that is supported by the horizontal beams and made to extend therebetween. The framing system is designed to carry all of the anticipated floor and roof loads as well as provide stabilization against horizontal forces due to wind, particularly through the floor slab which is generally required to transmit such forces to vertical stabilizing elements provided throughout the framing system.

In recent times, revised building codes throughout the country have increased seismic design criteria, especially in multi-story buildings, and as a result, the framing systems of most new building structures must provide more effective resistance to a wide range of seismic forces. Much of the existing structural framework employed in building construction over the last several decades, particularly the conventional block and precast plank bearing wall system, would fail to comply with recent seismic building code requirements and therefore require redesigned alternatives. At present, there have developed no alternative designs of structural framing systems that would satisfy all requisite loading requirements including those of seismic forces, and yet be implemented in an economical manner comparable to plank and masonry bearing wall, without adding undue height to the overall structure.

SUMMARY OF THE INVENTION

Accordingly, it is a general purpose and object of the present invention to provide an improved construction system and associated method for increasing the load carrying capabilities and characteristics of multi-story buildings.

A more specific object of the present invention is to provide a structural framing system and method of constructing same that would provide an effective and economical means for supporting modern-day building structures, particularly those multi-storied, and be capable of handling all loading requirements now specified under building codes including those associated with seismic activity without requiring additional height to the overall structure.

A still further object of the present invention is to provide a safe and effective structural framing system that may be easily implemented using relatively standard construction materials and techniques.

Briefly, these and other objects of the present invention are accomplished by an improved structural framing system and associated method for constructing same wherein a specially configured dissymetric steel beam is horizontally disposed and supported between adjacent vertical columns erected on conventional foundations. The dissymetric beam is fabricated having a compressed, block-like flange formed along the top length of the beam opposite a widened, substantially flattened flange along the bottom length and a uniform web integrally formed therebetween. Standard hollow core sections of precast, prestressed concrete plank adapted to span perpendicularly to the dissymetric beam are aligned and assembled in pairs on either side of the dissymetric beam supported upon the bottom flange thereof with the web disposed centrally between proximate edges of the assembled plank sections. With the top flange substantially aligned with the upper surface of the assembled plank sections, the assembly is injected with a high-strength grout mixture and allowed to set, thereby providing a total encasement of the dissymetric beam within the plank sections and producing a composite action therebetween that significantly increases the load capacity of the system.

For a better understanding of these and other aspects of the present invention, reference may be made to the following detailed description taken in conjunction with the accompanying drawing in which like reference numerals designate like parts throughout the figures thereof.

DESCRIPTION OF THE PREFERRED EMBODIMENT

Figure 1:
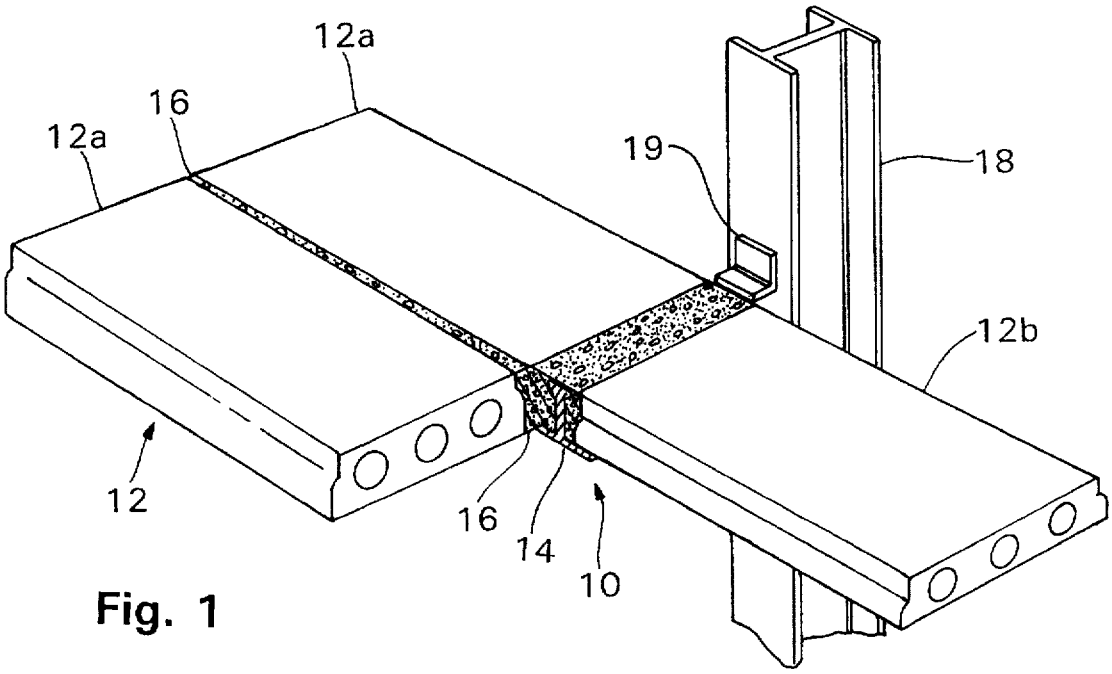
FIG. 1 is a forward perspective view of the structural framing system assembled and constructed in accordance with the present invention.
Figure 2:
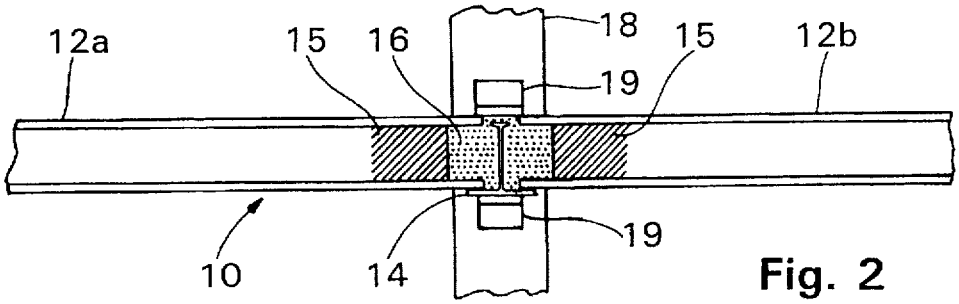
FIG. 2 is a front elevational view of the assembled framing system of FIG. 1 shown partially cross-sectioned.

Referring now to the drawings and in particular at first to FIGS. 1 and 2, there is shown a structural framing system, generally designated 10, constructed in accordance with the present invention. The framing system 10 incorporates a series of concrete plank sections, generally designated 12, installed in successive pairs **12*a*, 12*b* and joined together along either side of a specially-configured steel dissymetric beam 14 using a high-strength grout material 16, as further described in greater detail hereinbelow. The plank sections 12*a*, 12*b* extend outward from the dissymetric beam 14 and together span horizontally between adjacent vertical columns 18 that are fabricated of a structural steel material and erected on conventional foundations. Each dissymetric beam 14 is horizontally disposed and supported between the adjacent vertical columns 18 by means of support seats 19** or other standard beam-to-column connections secured to each vertical column.

The plank sections **12*a*, 12*b* are conventional precast and prestressed concrete members formed having a hollow core construction. The plank sections 12*a*, 12*b* installed in any specific structural framing system 10 are intended to have a substantially uniform thickness which may range from 6 to 12 inches depending upon the specific design criteria associated with the construction. The facing edges of each plank section 12, as best viewed in FIG. 2, are formed having an interior recess between the upper and lower plank surfaces which serves to surround the dissymetric beam 14 upon the assembly and installation of the associated sections 12***a*, 12*b* and thereupon provide an encasement cavity for injection of the high-strength grout material 16 at time of joinder to the beam. Standard core plugs 15 are inserted into the hollow core of each plank section 12*a*, 12*b* along its respective facing edge to further define and limit the encasement cavity and prevent the flow of the grout material 16 away from the intended joint immediately about the dissymetric beam 14.

Figure 3:
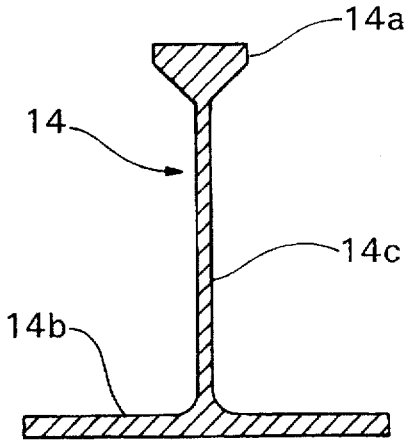
FIG. 3 is a cross-sectional view of the dissymetric beam used in accordance with the present framing system and shown apart therefrom.

Referring now to FIG. 3 in conjunction with FIGS. 1 and 2, the dissymetric beam 14 is specially configured and provided throughout its length with a compressed, block-like flange 14*a* formed along the top of the beam and a widened, substantially flattened flange 14*b* formed along the beam bottom. An intermediate web 14*c* having a substantially rectangular and uniform cross-section is integrally formed as an element of the dissymetric beam 14 and separates the respectively configured top and bottom flanges 14*a* and 14*b*. Preferably manufactured by rolling an integral piece of structural steel, the dissymetric beam 14 may vary in the specific metallurgy of its material and in the relative dimension of its elements based upon the design specifications and loading requirements of the framing system 10, with the height of the beam being substantially the same as the thickness of the plank sections 12*a*, 12*b*. The dissymetric beam 14 may alternatively be custom fabricated from standard structural steel stock provided the distinct configuration of the block-like top flange 14*a* is maintained vis-a-vis the widened bottom flange 14*b*.

In constructing the present structural framing system 10, the dissymetric beam 14 is lifted to a specific elevation and secured in a substantially horizontal position between adjacent vertical columns 18 supported upon and connected to seats 19 using conventional means for making the structural connection thereto. With the dissymetric beam 14 secured in such position having top flange 14*a* directed upwardly, the plank sections 12*a*, 12*b* are installed and assembled in pairs upon either side of the dissymetric beam. Each plank section 12*a*, 12*b* is positioned alongside the dissymetric beam 14 and spans outwardly therefrom in a substantially horizontal plane. Facing edges of the plank sections 12*a*, 12*b* are brought together to immediately abut the dissymetric beam so that the web 14*c* of the beam is centrally disposed between the edges with the bottom flange 14*b* supporting the lower surfaces of the respective plank sections. In this position with the edges of the plank sections 12*a*, 12*b* bearing upon the bottom flange 14*b* of the beam 14 and the plank sections in horizontal planar alignment, the upper surface of the top flange 14*a* is substantially aligned with the upper surface of the plank sections, as best viewed in FIG. 2.

The described assembly of the horizontally spanning plank sections 12*a*, 12*b* and centrally disposed dissymetric beam 14 is structurally joined together by a controlled grouting of the encasement cavity formed by facing edges of the plank sections at and along their bearing on the dissymetric beam. The high-strength grout material 16, typically rated in the range of 3,000–8,000 psi, is premixed and injected in a controlled fashion so that it completely fills the cavity and totally encases the dissymetric beam 14 therein. Adjacent pairs of plank sections 12*a*, 12*b* are further installed and assembled together in a similar fashion at or about substantially the same time so that the grouting of the assembled pairs of plank along the dissymetric beam 14 and between adjacent plank sections can proceed in a relative continuous operation. The process of installation and assembly of the plank sections 12*a*, 12*b* along the dissymetric beam and the grouting thereof continues throughout the story level between all vertical columns and is repeated for each story of the construction. It should be further noted that in addition to the aforedescribed elements comprising the inventive structural framing system 10 and used in the construction thereof, standard wide flange beams (not shown) temporarily connected to and between adjacent vertical columns 18 parallel to the span of the plank sections 12*a*, 12*b* are typically installed at each level and later removed after completion of a full span of the present framing system to provide stability to the overall structure during construction.

The disclosed construction of the structural framing system 10 produces a composite action between the dissymetric beam 14 and the plank sections 12*a*, 12*b* that significantly and unexpectedly increases the loadbearing capacity of the system far beyond that of the beam alone. The composite action of the present structural framing system 10, produced without use of shear connectors typically found atop steel beams in existing composite structures, is the result of geometric interlocking of the specially configured dissymetric beam 14 grouted and encased centrally between the plank sections 12*a*, 12*b* and perpendicular to the span thereof. The horizontal shear developed in the present framing system 10 by the geometric interlocking of its structural elements contributes substantially to a determined increase in loadbearing capacity of the system that is approximately three times that of the dissymetric beam 14 itself. The combination, therefore, of the dissymetric beam 14 and the grouted plank sections 12*a*, 12*b* of the present structural framing system 10 clearly evidences a synergistic effect with respect to the individual loadbearing capacities of individual structural elements. In this regard, a load test was performed upon an assembled structural framing system 10 constructed in accordance with the present invention. The load test was conducted in accordance with Section 1710.0 of the BOCA National Building Code (1993 Edition) covering preconstruction load testing of structural assemblies and specifically followed the test procedures set forth in Section 1710.3.1 thereof.

Figure 4:
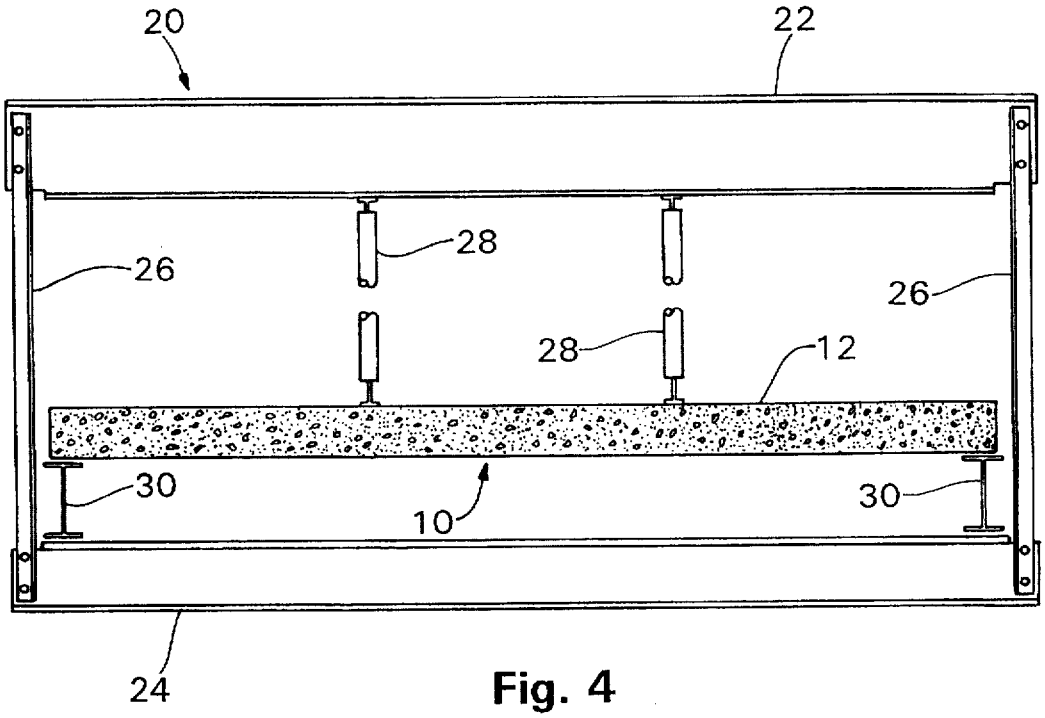
FIG. 4 is a side elevation of a testing station used to determine load capabilities of the present framing system.
Figure 5:
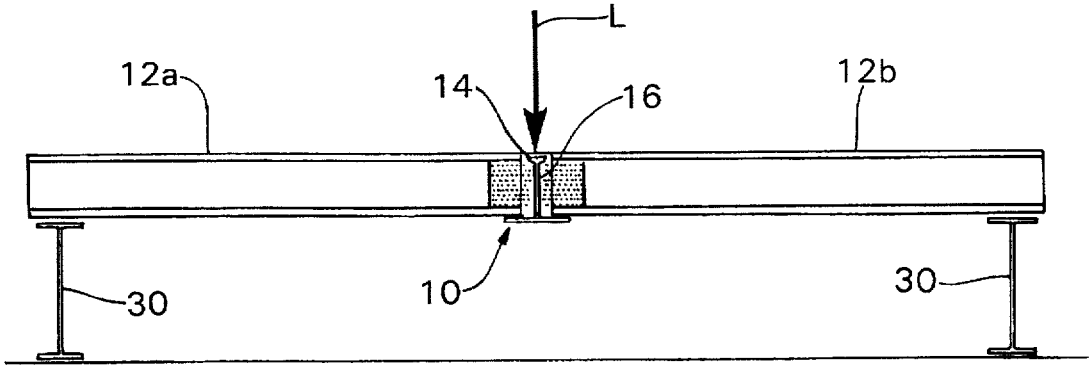
FIG. 5 is a forward view in schematic of the testing station of FIG. 4 showing the load applied to the framing system under test.

Referring now to FIGS. 4 and 5, a rigid test station, generally designated 20, is shown as the same was employed in conducting the BOCA load test procedures upon an assembled structural framing system 10. The test station 20 essentially comprised respective lengths of an upper and lower beam member, 22 and 24, spaced apart in elevation and rigidly coupled together by side frame members 26 extended between the upper and lower beam members and attached thereto at each end of the beam length. The respective upper and lower beam lengths 22 and 24 are substantially parallel and aligned with each other so that test loads applied between them are uniformly applied. A pair of hydraulic jacks 28 spaced apart and set beneath the upper beam length 22 are operated in unison to apply a controlled load L to the assembled framing system 10 under test directly to and along the encased dissymetric beam 14.

As better viewed in FIG. 4, the framing system 10 under test was positioned within the test station 20 between the upper and lower beam lengths 22 and 24, respectively, with the encased dissymetric beam 14 substantially aligned with the beam lengths. As tested, the framing system 10 comprised a series of three plank sections 12*a*, 12*b* in pairs assembled together and joined about a corresponding length of dissymetric beam 14, each plank section typically being 8 inches thick and approximately 4 feet in width (runing along the dissymetric beam) by 5 feet in length (extending outward from the dissymetric beam). To allow deflection of the framing system 10 under load, the entire span of the system was elevated above the lower beam length 24 upon support beams 30 stationed along each sides of the span outward from the dissymetric beam 14. The hydraulic jacks 28 were then applied to the top of the framing system 10 to subject the system to the controlled load L along the length of the dissymetric beam 14, as indicated in FIG. 5. The test load L applied to the framing system 10 was adjusted progressively and maintained at respective levels for an extended period of time, typically 24 hours, to determine actual deflection of the framing system under load and relative load capacity of the composite system in comparison with those theoretically associated with the steel beam only. The following Table I presents the load test results indicative of the significant enhancement of the loadbearing capabilities of the composite framing system 10:

TABLE I

| | | | | | | | | | |
|---|---|---|---|---|---|---|---|---|---|
| Load/Jack (kips) | 4 | 7 | 8 | 9 | 10 | 12 | 15 | 17 | 18.2 |
| Moment (ft-kips) | 16 | 28 | 32 | 36 | 40 | 48 | 60 | 68 | 72.8 |
| Theoretical Deflection Steel Only (inches) | ¼ | .426 | 0.5 | 0.5+ | 0.5+ | Failure | ∞ | ∞ | ∞ |
| Actual Deflection Composite System (inches) | 1/16 | ⅛ | 5/32 | ¼ | ¼ | 7/16 | ⅝ | ¾ | 13/16 |
| Load Capacity Increase (%) | 400 | 340 | 320 | 200+ | 200+ | (UNDETERMINED) | | | |

The foregoing test results indicate that the composite framing system 10 safely attained the BOCA required test load of 18.2 kips/jack. This test load determined by the BOCA Code is well in excess of the design load requirement for the assembled system, established to be at the level of 12 kips/jack. Therefore, the design load requirement of 12 kips is intended to simulate the full loading condition of the present framing system 10 in place within a constructed building and the test load requirement of 18.2 kips is intended to ensure that the system will safely carry the design load. It should be further noted that the dissymetric beam 14 theoretically acting alone would experience structural yield at the 7 kip load mark and would experience failure at the 12 kip mark. Thus, the loadbearing capacity of the present composite framing system 10 indicates an increase of approximately three times that of the steel beam alone, and evidences the development of a substantial horizontal shear in the composite system that is otherwise unexpected.

Therefore, it is apparent that the disclosed invention provides an improved composite framing system and associated method of construction which results in a significant and unexpected increase in the loadbearing capacity of the structural assembly and further in the load characteristics of the building in which the framing system is incorporated. The present composite framing system provides an effective and economical means for supporting modern-day building structures, particularly those multi-storied, which is capable of handling all loading requirements currently specified under applicable building codes, including those associated with seismic activity, without increasing the height of the overall structure. In addition, the present invention provides a safe and effective structural framing system that may be easily implemented using relatively standard construction materials and techniques.

Obviously, other embodiments and modifications of the present invention will readily come to those of ordinary skill in the art having the benefit of the teachings presented in the foregoing description and drawings. For example, the height of the web and cross-sectional area of the dissymetric beam may vary depending upon the size and thickness of the plank sections. Further, the grout mixture may certainly vary in its composition depending upon the beam and plank materials being employed and the recommendation of their respective manufacturers. It is therefore to be understood that various changes in the details, materials, steps and arrangement of parts, which have been described and illustrated to explain the nature of the present invention, may be made by those skilled in the art within the principles and scope of the invention as are expressed in the appended claims.

What is claimed:

1. A composite framing system for building construction, comprising:

a plurality of column members vertically erected;

a dissymetric beam member horizontally supported between adjacent column members, said dissymetric beam member being formed having a compressed, block-like flange configured along the top end thereof and a substantially flattened flange configured along the bottom end thereof;

a plurality of concrete plank sections assembled in pairs spanning perpendicularly to either side of said dissymetric beam with the facing edges of each pair of assembled plank sections supported upon the bottom flange of said dissymetric beam member, said plank sections being formed having a substantially uniform thickness and a hollow-cored interior, with an interior recess being further provided at each of the facing edges of said plank sections so that a cavity surrounds said dissymetric beam when assembled thereabout; and grout means for encasing the assembled plank sections in composite action with said dissymetric beam geometrically interlocked therebetween and thereby forming the composite framing system having enhanced load carrying capabilities.

2. A composite framing system according to claim 1, wherein said dissymetric beam is further formed to include a web integrally provided between the top and bottom flanges having a substantially rectangular and uniform cross-section throughout said dissymetric beam, the web being centrally disposed between the facing edges of each pair of assembled plank sections.

3. A composite framing system according to claim 2, wherein said grout means comprises:

a high-strength grout mixture premixed in sufficient quantity and injected into the interior recess along each of the facing edges of said plank sections to fill the cavity surrounding said dissymetric beam.

4. A composite framing system according to claim 3, further comprising:

a plurality of plug members inserted into the hollow-cored interior of said plank sections along the recess at each of the facing edges thereof to limit the cavity and prevent outward flow of said grout mixture.

5. A method of constructing a building structure, comprising the steps of:

erecting vertical columns;

supporting a dissymetric beam horizontally between adjacent vertical columns, said dissymetric beam being formed having a compressed, block-like flange along the upper length thereof and a flattened flange formed along the lower length thereof;

installing a plurality of concrete plank sections in pairs along either side of said dissymetric beam supported upon the bottom flange thereof, the plank sections being assembled together in a horizontal plane spanning perpendicularly to either side of the dissymetric beam with a cavity formed immediately surrounding the beam; and grouting the installed plank sections immediately surrounding said dissymetric beam encased therebetween to form a geometrical interlocking composite framing structure having enhanced load carrying capabilities.

6. A method of constructing a building structure according to claim 5, wherein said step of supporting the dissymetric beam comprises:

lifting the dissymetric beam to a specific story level of the building structure; and connecting each end of the dissymetric beam to a respective one of the adjacent vertical columns in a substantially horizontal position having the block-like flange upwardly directed.

7. A method of constructing a building structure according to claim 4, wherein said step of grouting the installed plank sections comprises:

injecting a premixed amount of a high-strength grout material between the installed plank sections and into the cavity surrounding the dissymetric beam.

8. A composite structural member, comprising:

a dissymetric beam fabricated having a compressed, block-like flange formed along the top length thereof and a flattened flange along the bottom;

a pair of concrete plank sections assembled together along facing edges thereof and installed to span perpendicularly to either side of said dissymetric beam supported upon the bottom flange thereof, said plank sections being fabricated having a substantially uniform thickness and a hollow-cored interior, and further formed having an interior recess at each of the facing edges of said plank sections so that a cavity surrounds the dissymetric beam when assembled thereabout; and means for grouting said pair of plank sections together with said dissymetric beam encased therebetween to produce a geometrical interlocking composite structure having enhanced load carrying capabilities.

9. A composite structural member according to claim 8, wherein said dissymetric beam is further fabricated having a web integrally provided between the top and bottom flanges, the web having a substantially rectangular and uniform cross-section throughout said dissymetric beam.

10. A composite structural member according to claim 12, wherein said grouting means comprises:

a high-strength grout mixture premixed in sufficient quantity and injected into the interior recess along each of the facing edges of said plank sections to fill the cavity surrounding said dissymetric beam.

11. A composite structural member according to claim 10, further comprising:

a plurality of plug members inserted into the hollow-cored interior of said plank sections along the recess at each of the facing edges thereof to limit the cavity and prevent outward flow of said grout mixture.

* * * * *